US007028739B2

(12) United States Patent
Hsu

(10) Patent No.: US 7,028,739 B2
(45) Date of Patent: Apr. 18, 2006

(54) ROLLER MOUNT ON THE UPPER BEAM OF VENETIAN BLIND

(75) Inventor: Ben Hsu, Changhua Hsien (TW)

(73) Assignee: Ching Feng Blinds Ind. Co., Ltd., Changhua Hsien (TW)

( * ) Notice: Subject to any disclaimer, the term of this patent is extended or adjusted under 35 U.S.C. 154(b) by 13 days.

(21) Appl. No.: 10/843,312

(22) Filed: May 12, 2004

(65) Prior Publication Data

US 2005/0252621 A1 Nov. 17, 2005

(51) Int. Cl.
*E06B 9/32* (2006.01)

(52) U.S. Cl. ..... 160/173 R; 160/177 R

(58) Field of Classification Search ..... 160/173 R, 160/168.1 R, 176.1 R, 177 R, 178.1 R, 172 R
See application file for complete search history.

(56) References Cited

U.S. PATENT DOCUMENTS 4,643,238 A * 2/1987 Tachikawa et al. ... 160/168.1 R
5,538,066 A * 7/1996 Liu ..... 160/173 R
6,095,228 A * 8/2000 Liu ..... 160/173 R
6,189,596 B1 * 2/2001 Chen ..... 160/176.1 R
6,588,481 B1 * 7/2003 Hsu ..... 160/173 R

* cited by examiner

*Primary Examiner*—David Purol

(57) ABSTRACT

A roller mount on the upper beam of a Venetian blind is made up of a bottom board, and a pair of opposite side boards wherein each side board thereof is provided with an arc opening through hole concaved at the upper edge thereof for a protruded fixing post of an adjusting wheel to be mounted thereon, and the bottom board thereof is equipped with a central round through hole and a pair of squared through holes with a pair of vertical supporting walls extending symmetrically between the central through hole and the squared through holes to define an elongated engaging chamber there-between for a roller to be housed therein. An arc slide guiding recess and a spherical retaining cavity are vertically cut at the corresponding inner side of the opposite supporting walls thereon respectively, and a spherical locating end of the roller is stably fixed at the retaining cavity therein to form a retaining fulcrum at one side of the roller, permitting a slant guide post disposed at the other side of the roller thereof to slide and rotate smoothly along the slide guiding recess therein according to the traction or releasing movement of a pull cord so as to properly adjust the positions of the roller in any angles therewith, facilitating a smoother rotation of the roller and preventing it from getting stuck in operation thereof.

3 Claims, 5 Drawing Sheets

ROLLER MOUNT ON THE UPPER BEAM OF VENETIAN BLIND

BACKGROUND OF THE INVENTION

The present invention is related to a roller mount on the upper beam of a Venetian blind, including a roller mount made up of a bottom board, and a pair of opposite side boards wherein each side board thereof is provided with an arc opening through hole for a protruded fixing post of an adjusting wheel to be mounted thereon, and the bottom board thereof is equipped with a central round through hole and a pair of squared through holes with a pair of vertical supporting walls extending symmetrically between the central and the squared through holes to define an elongated engaging chamber there-between for a roller to be housed therein. An arc slide guiding recess and a spherical retaining cavity are vertically cut at the corresponding inner side of the opposite supporting walls thereon respectively, and a spherical locating end of the roller is stably fixed at the retaining cavity therein to form a retaining fulcrum at one side of the roller, permitting a slant guide post disposed at the other side of the roller thereof to slide and rotate smoothly along the slide guiding recess therein according to the traction or releasing movement of a pull cord so as to properly adjust position of the roller in any angles therewith, facilitating a smoother rotation of the roller thereof and preventing it from getting stuck in operation thereof.

Please refer to FIG. 1. A conventional roller mount on the upper beam of a Venetian blind includes a roller mount 10, an adjusting wheel 20, and a roller 30. The roller mount 10 is made up of a bottom board 11, and a pair of opposite side boards 12 extending at both lateral sides of the bottom board 11 thereof. Each side board 12 thereof has an arc opening through hole 13 concaved at one side of the upper edge thereon, and the bottom board 11 is provided with a round through hole 14 disposed at the center thereon, a pair of square holes 15 symmetrically disposed at both sides of the round through hole 14 thereof, and a pair of opposite supporting walls 16 symmetrically protruding between the round and square through holes 14, 15 thereof to define an elongated engaging chamber 17 there-between. Obliquely extended and opposite retaining cavities 18 are defined at the corresponding inner sides of the supporting walls 16 thereon respectively. The adjusting wheel 20 has a fixing post 21 with a larger flange 22 protruding at both ends thereof respectively, and a squared engaging hole 23 disposed at the center of the end surface thereon. The roller 30 is provided with an engaging post 31 extending at both ends thereon respectively. In assembly, the roller 30 is housed at the elongated engaging chamber 17 therein with the engaging posts 31 thereof located at the retaining cavities 18 of the supporting walls 16 therein for mutual engagement therewith. The fixing posts 21 of the adjusting wheel 20 are respectively mounted to the opening through holes 13 of the side boards 12 with the larger flanges 22 thereof extending at the outer side of the side boards 12 for limitation thereby.

Please refer to FIG. 2. A multiple of the roller mounts 10 are fixed to proper positions at an upper beam A of the Venetian blind before a square rod B as shown in FIG. 1 is led through the squared engaging holes 23 of the adjusting wheels 20 attached at the top of the roller mounts 10 thereof for synchronic linking actuation thereof. T-shaped cords of the Venetian blind are led through cord passages at the bottom side of the upper beam A and extended upwards through the square through holes 15 of the roller mounts 10 to be fixedly attached to the adjusting wheels 20 thereon respectively. A pull cord D is applied to pass through a cord hole at the bottom side of the upper beam A and the round hole 14 of the roller mount 10 respectively and wind through the roller 30 retained at the roller mount 10 therein before led through an adjustment unit C to complete the assembly thereof.

There are some drawbacks to such conventional roller mount on the upper beam of a Venetian blind. Most of all, the roller 30 engaged with the retaining cavities 18 of the roller mount 10 at both ends thereof is fixedly tilted into a specific angle. When the pull cord D is extended from the roller 30 to the adjustment unit C, different angles of the pull cord D are produced according to the distance between the adjustment unit C and the roller 30 thereof. In case of a too long or too short distance there-between, the pull cord D tends to deviate from the precise perpendicular position to the roller 30 thereof. Thus, in operation, great deviation of the pull cord D is easily produced as shown in FIG. 3, which can make the roller 30 rather difficult to rotate and even get stuck thereby, and the pull cord D awkwardly operated in the traction or releasing movement thereof.

SUMMARY OF THE PRESENT INVENTION

It is, therefore, the primary purpose of the present invention to provide a roller mount on the upper beam of a Venetian blind, including a roller mount made up of a bottom board, and a pair of opposite side boards wherein an arc slide guiding recess and a spherical retaining cavity are vertically cut at the corresponding inner side of opposite supporting walls of the roller mount thereon respectively, and a spherical locating end of a roller is stably fixed at the retaining cavity therein to form a retaining fulcrum at one side of the roller, permitting a slant guide post disposed at the other side of the roller thereof to slide and rotate smoothly along the slide guiding recess therein according to the traction or releasing movement of a pull cord so as to properly adjust the position of the roller in any angles therewith, facilitating a smoother rotation of the roller thereof and preventing it from getting stuck in operation thereof.

DETAILED DESCRIPTION OF THE PREFERRED EMBODIMENTS

Figure 4:
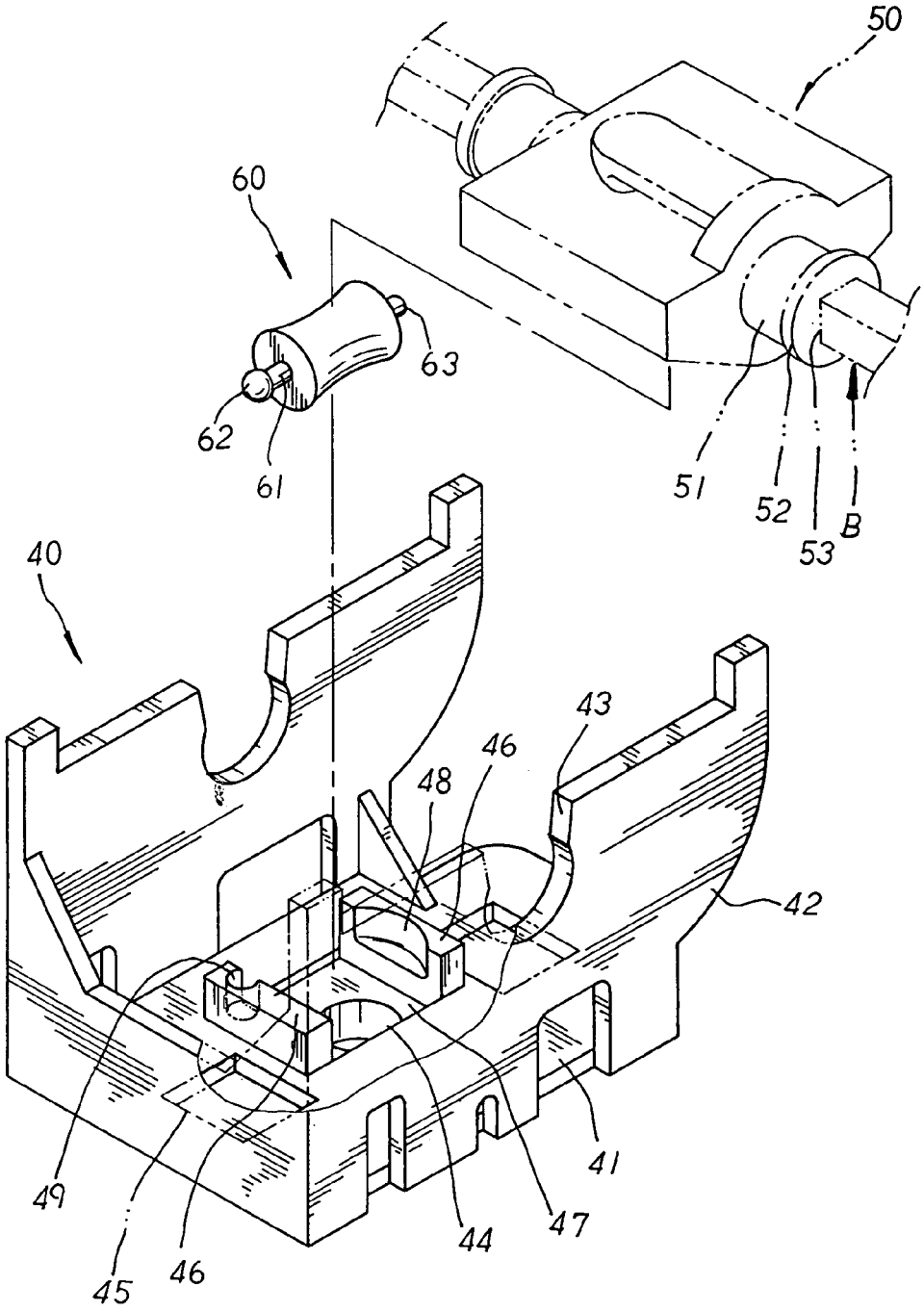
FIG. 4 is a perspective exploded view of the present invention.

Please refer to FIG. 4. The present invention is related to a roller mount on the upper beam of a Venetian blind, including a roller mount 40 made up of a bottom board 41 and a pair of opposite side boards 42 extending at both lateral sides of the bottom board 41 thereof. Each side board 42 is provided with an arc opening through hole 43 concaved at one side of the upper edge thereof for a protruded fixing post 51 of an adjusting wheel 50 to be mounted thereon and limited by a protruded flange 52 of the adjusting wheel 50 thereof. The protruded fixing post 51 of the adjusting wheel 50 has a squared engaging hole 53 disposed at the end surface thereon. The bottom board 41 is equipped with a round through hole 44 disposed at the center thereon, a pair of squared through holes 45 symmetrically disposed at both lateral sides thereon, and a pair of opposite supporting walls 46 vertically extending between the round through hole 44 and the squared through holes 45 thereof to define an elongated engaging chamber 47 transversely disposed therebetween. An arc slide guiding recess 48 and a spherical retaining cavity 49 with a side opening are vertically cut at the corresponding inner side of the opposite supporting walls 46 thereon respectively for a roller 60 to be mounted thereby. The roller 60 has an engaging post 61 with a spherical locating end 62 protruding at one side thereof to be registered with the spherical retaining cavity 49 of one supporting wall 46 thereby, and a guide post 63 with a slant end disposed at the other side thereof to be adapted and limited at the arc slide guiding recess 48 of the other supporting wall 46 therein. Thus, the spherical locating end 62 of the roller 60 is stably fixed at the retaining cavity 49 therein to form a retaining fulcrum at one side of the roller 60 for the slant guide post 63 disposed at the other side of the roller 60 thereof to slide smoothly along the slide guiding recess 48 thereof.

Figure 1:
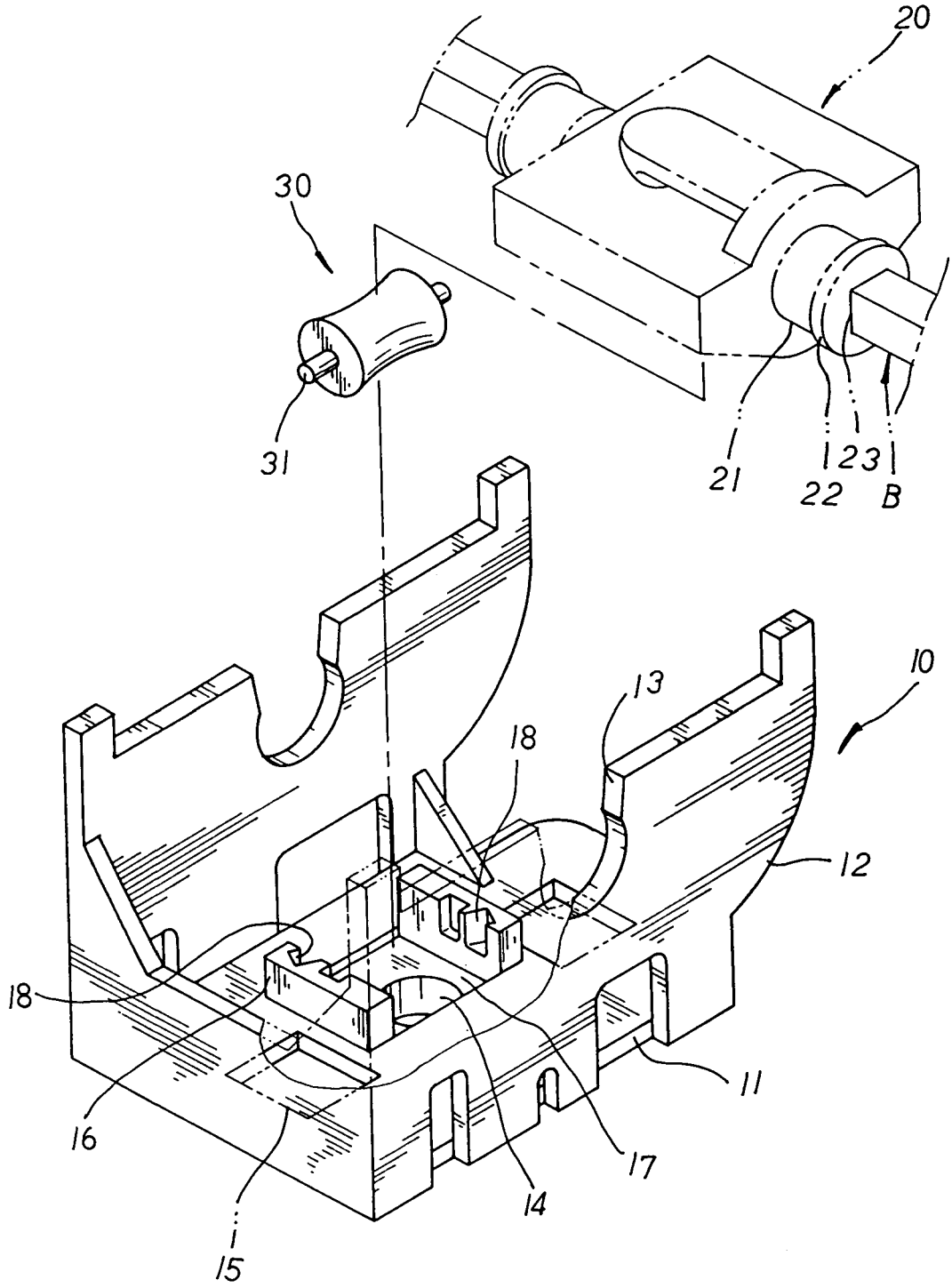
FIG. 1 PRIOR ART
FIG. 1 is a perspective exploded view of a conventional roller mount on the upper beam of a Venetian blind.
Figure 2:
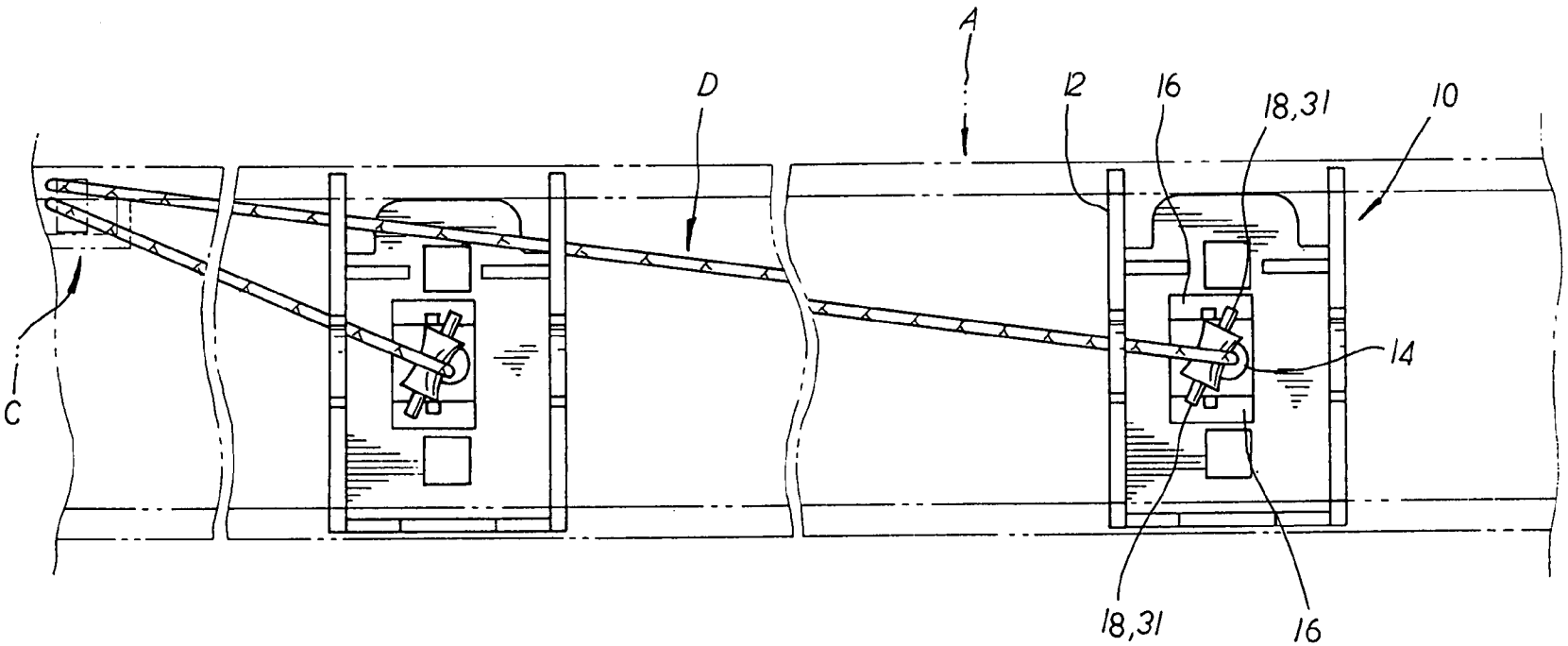
FIG. 2 PRIOR ART
FIG. 2 is a diagram showing the conventional roller mount on the upper beam of a Venetian blind in operation.
Figure 3:
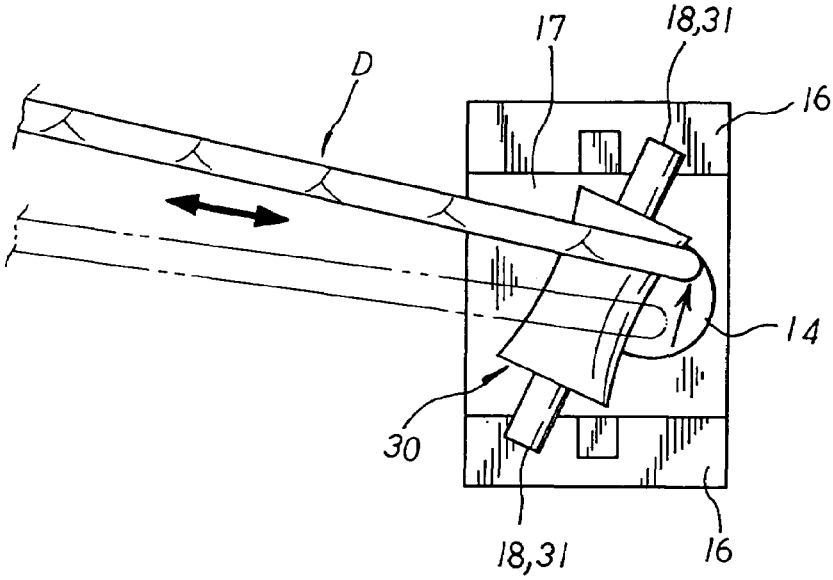
FIG. 3 PRIOR ART
FIG. 3 is a diagram shown the deviation of a pull cord of the conventional roller mount on the upper beam of a Venetian blind in operation.
Figure 6:
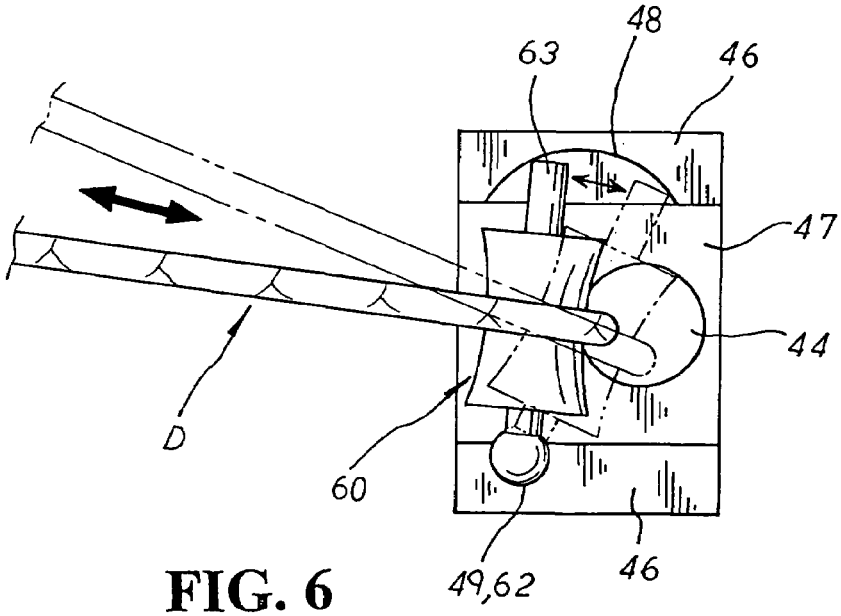
FIG. 6 is a diagram showing the actuation of a roller according to the movement of a pull cord of the present invention.
Figure 5:
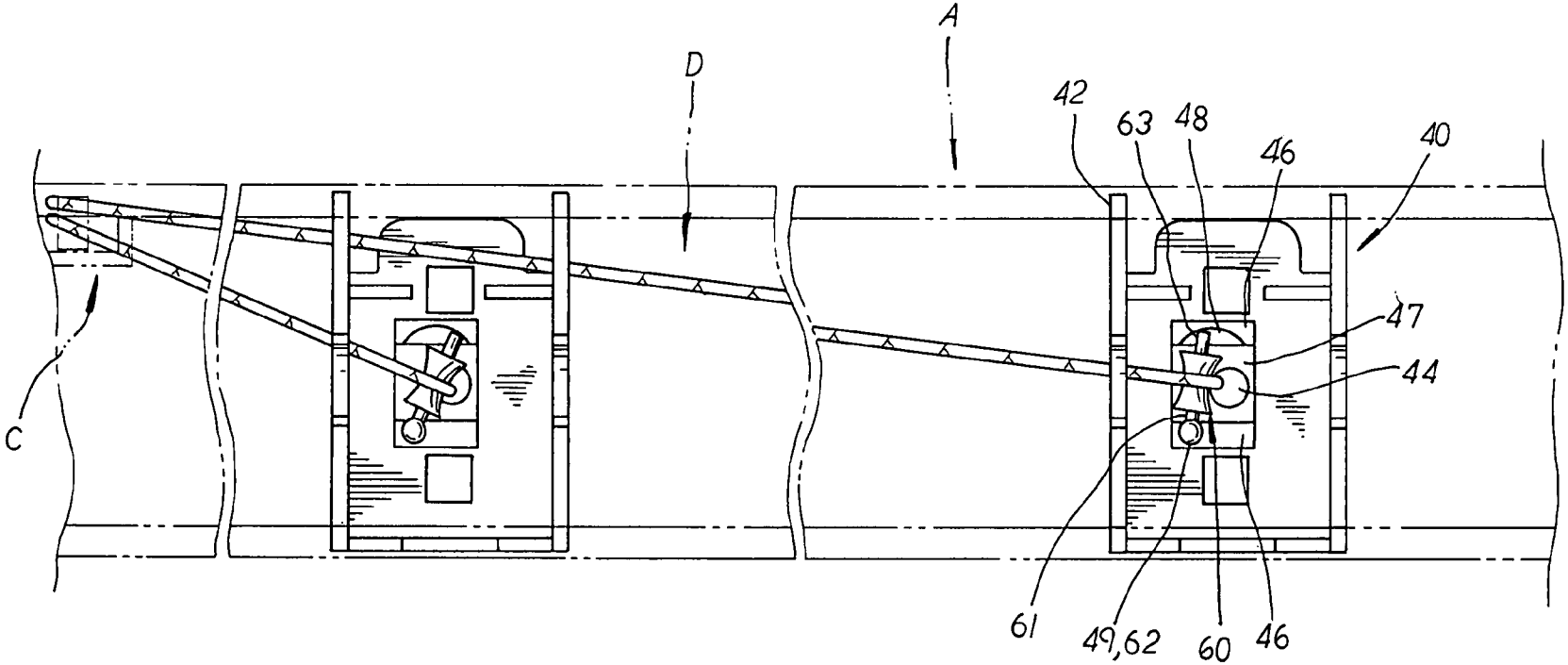
FIG. 5 is a diagram showing the present invention in practical use.

Please refer to FIG. 5. In assembly, a multiple of the roller mounts 40 are fixedly located to proper positions at an upper beam A of the Venetian blind before a square rod B as shown in FIG. 4 is led through the adjusting wheels 50 attached at the top of the roller mounts 40 thereof for synchronic linking actuation thereof. T-shaped cords of the Venetian blind are led through cord passages at the bottom side of the upper beam A and extended upwards through the squared through holes 45 of the roller mounts 40 to be fixedly attached to the adjusting wheels 50 thereon respectively. A pull cord D is applied to pass through a cord hole at the bottom side of the upper beam A and the central round hole 44 of the roller mount 40 respectively and wind through the roller 60 retained at the roller mount 40 therein before led through an adjustment unit C. In practical use when the pull cord D is drawn downwards to gather up the Venetian blind thereof, the traction produced thereby will actuate the roller 60 to adjust its angles randomly therewith. The spherical locating end 62 of the engaging post 61 thereof protruding at one side of the roller 60 will form a retaining fulcrum at the retaining cavity 49 therein, permitting the slant guide post 63 disposed at the other side of the roller 60 to slide smoothly along the slide guiding recess 48 therein so as to verify the positions of the roller 60 in any angles according to the traction of the pull cord D thereof. When the pull cord D is released to unfold the Venetian blind thereof, the slant guide post 63 without the traction of the pull cord D will slide back to the other side of the slide guiding recess 48, properly readjusting the angles of the roller 60 relative to the movement of the pull cord D as shown in FIG. 6. Thus, the roller 60 is more smoothly rotated and efficiently prevented from getting stuck in operation thereof.

What is claimed is:

1. A roller mount structure for a Venetian blind comprising:

a) a roller mount connected to an upper beam of the Venetian blind and having:

i) a bottom board having two square holes and a bottom hole located between the two square holes;

ii) two side boards extending upwardly from opposing sides of the bottom board, each of the two side boards having an arc opening located through an upper edge thereof; and iii) two supporting walls, one of the two supporting walls is located between the bottom hole and each of the two square holes, a first of the two supporting walls having an arc slide guiding recess, a second of the two supporting walls having a spherical retaining cavity;

b) an adjusting wheel having two fixing posts, each of the two fixing posts having a protruding flange and a square through hole, one of the two fixing posts being connected to each of two opposing ends of the adjusting wheel and rotatably located in the arc opening of each of the two side boards, a square rod of the Venetian blind is inserted through each square through hole; and c) a roller having an engaging post located on a first end thereof and a slant guide post located on a second end thereof, the engaging post having a spherical locating end located in the spherical retaining cavity, the slant guide post located in the arc slide guiding recess.

2. The roller mount structure according to claim 1, wherein the arc slide guiding recess has a curved wall extending downwardly from a top edge of the first of the two supporting walls.

3. The roller mount structure according to claim 1, wherein the spherical retaining cavity having a vertical side opening.

* * * * *